United States Patent [19]

Carman

[11] 4,102,405

[45] Jul. 25, 1978

[54] GOLF SAND-TRAP SMOOTHING IMPLEMENT

[76] Inventor: Edward W. Carman, P.O. Box Elmer, Almond Rd., Elmer, N.J. 08318

[21] Appl. No.: 741,492

[22] Filed: Nov. 12, 1976

Related U.S. Application Data

[63] Continuation-in-part of Ser. No. 712,202, Aug. 6, 1976, abandoned.

[51] Int. Cl.[2] ..... A01B 1/10; A63B 57/00

[52] U.S. Cl. ..... 172/378; 273/32 B

[58] Field of Search ..... 172/371, 372, 375, 378, 172/381; 56/400.01, 400.16, 400.21; 30/34.2, 172, 306, 307, 319; 15/187, 210.5; 7/13.1; 273/32 B

[56] References Cited

U.S. PATENT DOCUMENTS

| | | | |
|---|---|---|---|
| 522,465 | 7/1894 | Goodnough | 7/13.1 |
| 613,572 | 11/1898 | Hunt | 30/307 X |
| 1,541,643 | 6/1925 | Hendricks | 172/372 |
| 3,123,911 | 3/1964 | Snyder | 30/172 |
| 3,193,999 | 7/1965 | Hester | 56/400.16 |
| 3,233,272 | 2/1966 | Pambello | 15/187 X |
| 3,945,080 | 3/1976 | Hamner | 15/187 |
| 3,994,652 | 11/1976 | Kuzyk | 30/307 X |

FOREIGN PATENT DOCUMENTS

| | | | |
|---|---|---|---|
| 218,261 | 11/1958 | Australia | 15/187 |
| 54,232 | 2/1948 | France | 30/34.2 |

*Primary Examiner*—Richard T. Stouffer
*Attorney, Agent, or Firm*—Berman, Aisenberg & Platt

[57] ABSTRACT

An implement for smoothing the surface of sand in a golf course sand-trap is described. The smoothing portion of the implement comprises a substantially cylindrical body having tapered ends designed to be drawn through the sand, just below its surface, by an elongated handle joined to the cylindrical body at its mid-point. In one embodiment, the surface of the cylindrical body is smooth over its entire extent, while in other embodiments the surface is provided with a series of parallel, circumferentially and equally spaced circular ridges.

7 Claims, 10 Drawing Figures

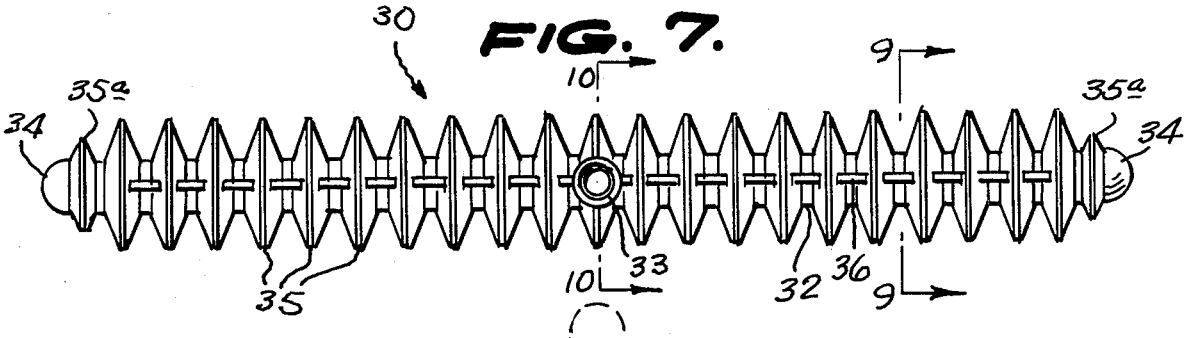
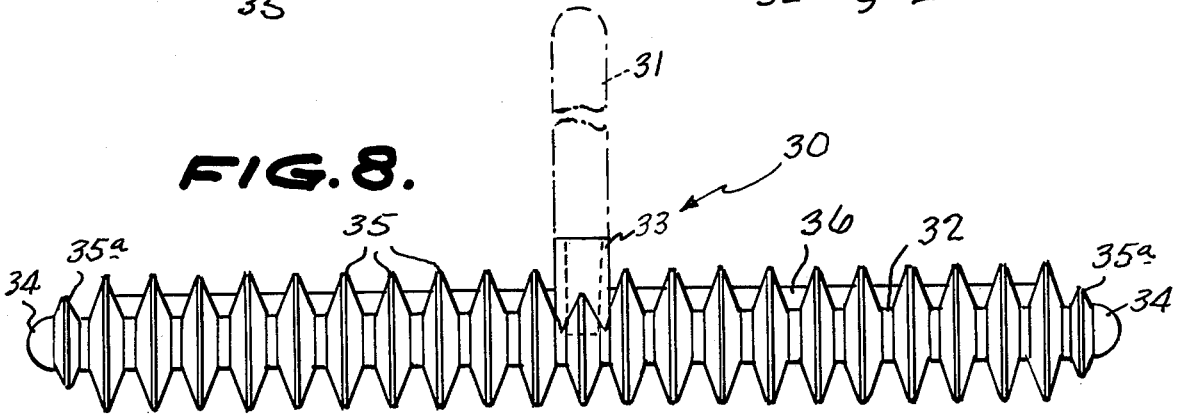
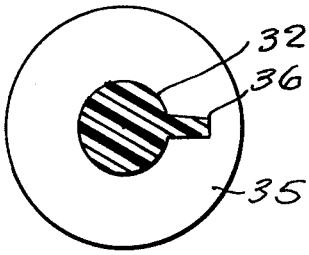
FIG. 9.
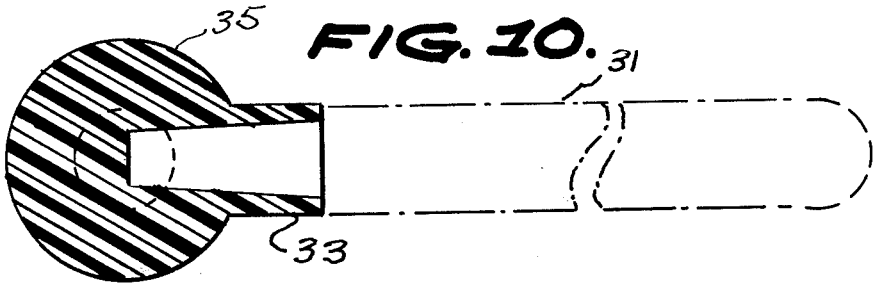
FIG. 10.

GOLF SAND-TRAP SMOOTHING IMPLEMENT

RELATED APPLICATIONS

This application is a continuation-in-part of application Ser. No. 712,202 filed Aug. 6, 1976, now abandoned.

BACKGROUND OF THE INVENTION

1. Field of the Invention

The present invention is directed to a device for smoothing surfaces and, more particularly, is directed toward an implement for smoothing the surface of sand in a golf course sand-trap.

2. Description of the Prior Art

As is well known to golfing enthusiasts and those charged with the maintenance of golf courses, the condition of sand traps is of paramount importance in insuring an optimal playing environment. Specifically, the surface of the trap must be smooth and free from depressions and pronounced ridges. To this end, sand-traps have been provided with smoothing implements in a readily accessible location to be utilized by a player for restoring the smooth surface of the trap after hitting a shot therefrom and by maintenance personnel for creating a smooth trap surface prior to the commencement of play.

Heretofore, the smoothing implement has taken the form of a conventional garden rake, usually constructed of wood.

The use of the conventional form of rake for sand-trap smoothing has presented severe problems. The basic function of the conventional rake is to extract extraneous materials from granular mixtures. Thus, the rake carries teeth which strain or sieve larger objects from the sand. In use, the toothed section tends to create ridges in the surface of the sand which are undesirable from the standpoint of achieving a smooth surface. Moreover, the toothed section of the rake is usually manufactured separately and affixed to a handle. Both the handle and the teeth tend to break when the rake is mishandled or run over by a golf cart as frequently happens.

OBJECTS AND SUMMARY OF THE INVENTION

It is therefore a primary object of the present invention to provide a sand-trap smoothing implement which creates a uniformly smooth surface.

Another object of the present invention is to provide a sand-trap smoothing implement which is not readily susceptible to breakage, which is impervious to the ravages of weather and which renders satisfactory service over an extended period of years.

A further object of the present invention is to provide a sand-trap smoothing implement which may be readily and economically manufactured in a substantially unitary construction.

The foregoing and other objects are attained in accordance with the present invention by providing a sand-trap smoothing implement in which the smoothing portion thereof comprises a substantially cylindrical body having tapered ends designed to be drawn through the sand, just below its surface, by an elongated handle joined to the cylindrical body at its mid-point. In one embodiment, the surface of the cylindrical body is smooth over its entire extent, while in a second embodiment the surface is provided with a series of parallel circumferentially and equally spaced circular ridges. In a third embodiment, the surface of the cylindrical body is provided with circular ridges having wedge-like edges to assist in penetrating the surface of the sand-trap when the sand is damp or otherwise in a tightly packed condition.

In operation, the cylindrical section is drawn laterally through the sand, an inch or so beneath the surface so that the sand granules glide over the rounded surface of the implement and fill in the irregular dents and depressions in the surface of the sand-trap. By then lifting the implement from the sand-trap and drawing it lightly over the surface of the sand, a smooth, even, non-striated appearance is achieved. In some instances, a slightly striated surface may be considered desirable and in such case, the second or third embodiments may be employed wherein the cylindrical surface is provided with the circular ridges.

The implement is formed in a substantially unitary construction of lightweight materials, such as plastic or the like. The cylindrical section in the first and second embodiments is hollow and injection-molded of polyethylene. In the third embodiment, the cylindrical section is preferably solid and blow-molded of high impact styrene. The handle is preferably formed of extruded glass polyester. The handle may be press-fit into a collar provided on the cylindrical section and permanently affixed in place by means of an epoxy resin adhesive or the like.

BRIEF DESCRIPTION OF THE DRAWINGS

Various objects, features and attendant advantages of the present invention will be more fully appreciated as the same becomes better understood from the following detailed description thereof when considered in connection with the accompanying drawings, in which:

FIG. 7 is a top plan view of a third embodiment of the invention;

FIG. 8 is a front elevation of the embodiment shown in FIG. 7;

FIG. 9 is a section taken through line 9—9 in FIG. 7, looking in the direction of the arrows; and FIG. 10 is a section taken through line 10—10 in FIG. 7, looking in the direction of the arrows.

DETAILED DESCRIPTION OF THE PREFERRED EMBODIMENTS

Figure 1:
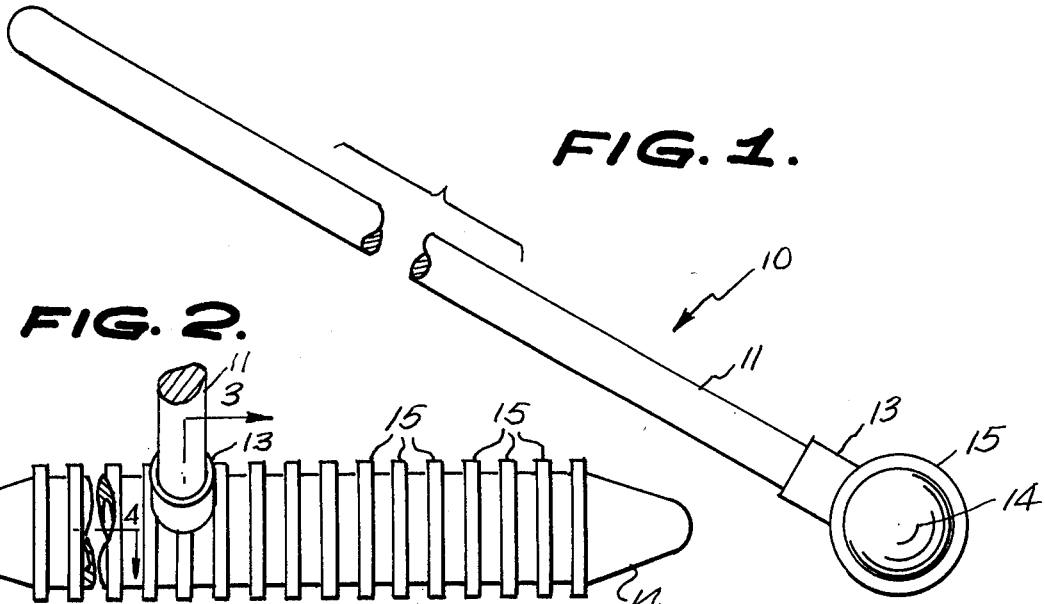
FIG. 1 is an end elevation of one embodiment of the golf sand-trap smoothing implement according to the present invention.
Figure 2:
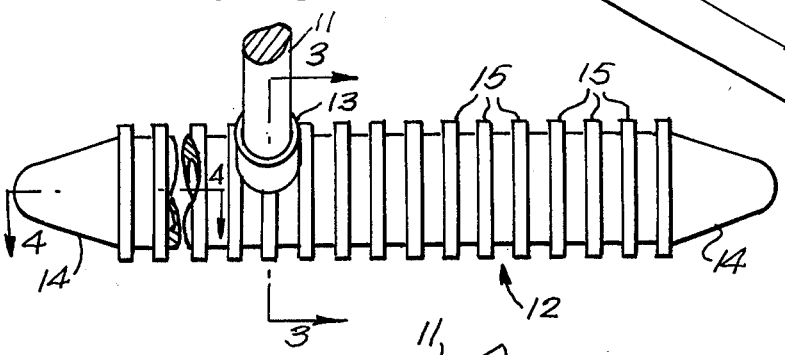
FIG. 2 is a front elevation of the embodiment illustrated in FIG. 1.

Referring now to the drawings, wherein like reference numerals indicate identical or corresponding parts throughout the several views, and more particularly to FIGS. 1, 2, 3 and 4 thereof, a first embodiment of the golf sand-trap smoothing implement is indicated generally therein by the reference numeral 10.

The sand-trap smoothing element 10 includes a substantially cylindrical body 12 which performs the smoothing function and a handle 11 joined thereto at its approximate mid-point by means of cylindrical collar 13, for manipulating the cylindrical body 12. The ends of the cylindrical body 12 are tapered at 14 for a reason which will appear more fully below.

Integrally formed with the cylindrical body 12 are parallel, circumferentially and equally spaced circular ridges 15. The purpose of the ridges 15 is to impart a slightly striated appearance to the surface of the sand when the smoothing implement 10 is utilized in the manner described hereinbelow.

Figure 3:
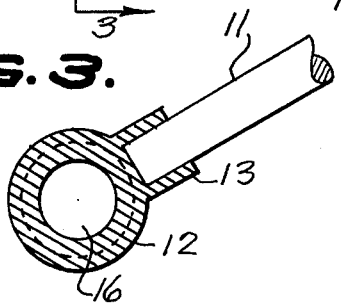
FIG. 3 is a side sectional view taken through the line 3—3 of FIG. 2 and looking in the direction of the arrows.
Figure 4:
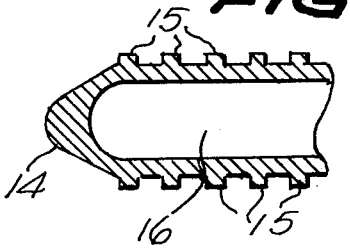
FIG. 4 is a partial top sectional view taken along the line 4—4 in FIG. 2, looking in the direction of the arrows.

As shown most clearly in FIG. 3, handle 11 may be joined to cylindrical body 12 by a friction fit within collar 13. To securely affix handle 11 within collar 13, an epoxy resin adhesive or the like may be employed. As illustrated in FIGS. 3 and 4, the interior 16 of cylindrical body 12 is preferably hollow to impart lightness to the implement 10.

Figure 5:
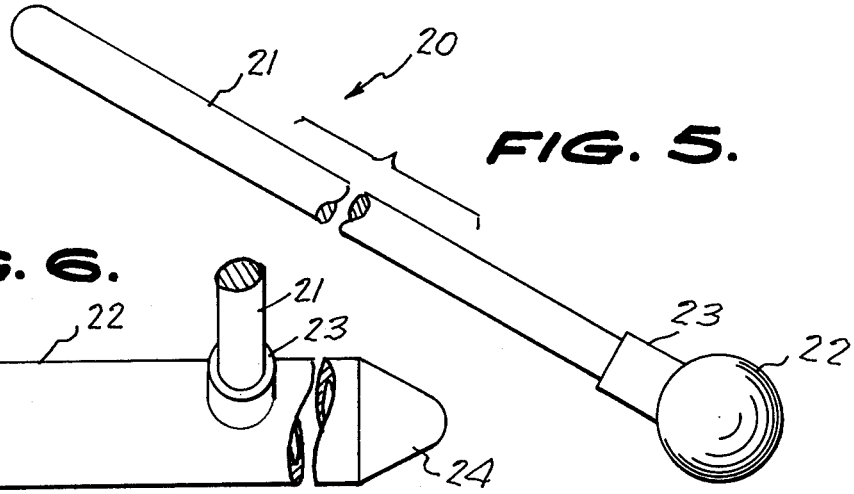
FIG. 5 is an end elevation of a second embodiment of the invention.
Figure 6:
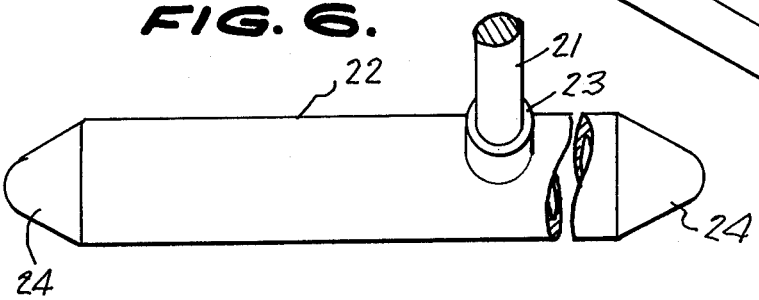
FIG. 6 is a front elevation of the embodiment illustrated in FIG. 5.

Referring now to FIGS. 5 and 6, there is illustrated a second embodiment of the sand-trap smoothing implement according to the present invention, generally designated by the reference numeral 20. Like the first embodiment described above with respect to FIGS. 1 through 4, the smoothing implement 20 includes an elongated handle 21 joined to the cylindrical body 22 by means of collar 23. As in the first embodiment, the cylindrical body 22 is provided with tapered ends 24 and has a hollow interior.

The only difference between the embodiments of FIGS. 1 through 4 and FIGS. 5 and 6 is that the cylindrical body 22 is smooth throughout the extent of its surface. Thus, the smoothing implement 20 will be utilized whenever it is desired to create a completely smooth surface for the sand-trap, rather than the slightly striated surface produced by the smoothing implement 10.

Turning now to FIGS. 7, 8, 9 and 10, there is illustrated a third and preferred embodiment of the sand-trap smoothing implement according to the present invention, generally designated by the reference numeral 30. As in the case of the first and second embodiments described above, the smoothing implement 30 comprises a cylindrical body 32 having tapered and rounded ends 34. Joined to cylindrical body 32 by means of collar 33 is elongated handle 31, shown in dotted outline in FIGS. 8 and 10.

Cylindrical body 32 is provided with circular ridges 35 having wedge-shaped edges, for reasons which will appear more fully below. Disposed at either end of cylindrical body 32, in proximity to tapered ends 34, are smaller circular ridges **35*a*. Reinforcing rib 36 extends between the two outermost circular ridges 35**.

Preferably, cylindrical bodies 12 and 22 are formed of polyethylene and injection-molded, while cylindrical body 32 is blow-molded of high impact styrene. Handles 11, 21 and 31 are preferably extruded glass polyester.

Cylindrical bodies 12 and 22 are preferably 1 to 3 inches in diameter and nine to eighteen inches in length. Cylindrical body 32 is preferably about one-half inch in diameter and 9 to 18 inches in length. Handles 11, 21 and 31 are preferably from one-half inch to 1 inch in diameter and from 3 to 5 feet in length, with the optimum length being approximately 44 inches. In the embodiment of FIGS. 1 through 4, ridges 15 extend approximately three-sixteenths of an inch above the surface of cylindrical body 12, are approximately three-sixteenths of an inch wide and are spaced approximately one-quarter of an inch apart. In the embodiment of FIGS. 7 through 10, circular ridges 35 extend approximately one-half inch above the surface of cylindrical body 32, are approximately one-half inch in width at their widest point and are spaced approximately one-eighth of an inch apart. Smaller ridges **35*a* extend approximately one-quarter of an inch above the surface of cylindrical body 32, are approximately one-quarter inch in width at their widest point and are spaced one-eighth inch from the outermost ridges 35**.

In the operation of smoothing implements 10 or 20, the handle is grasped and the cylindrical body is drawn laterally through the sand, approximately an inch or so beneath the surface. The sand granules glide over the rounded surface of the implement and fill in the irregular dents and depressions. The tapered ends of the cylindrical body prevent ridges from forming in the sand. The implement is then lifted and drawn lightly over the surface of the sand, thus creating a smooth, even, non-striated appearance in the case of smoothing implement 20 and a slightly striated appearance in the case of smoothing implement 10. The operation of smoothing implement 30 is similar to that described above, except that this implement is utilized when the sand is tightly packed. The wedge-like edges of circular ridges 35 enable the implement to more easily penetrate the surface of the sand-trap. The unitary and lightweight construction of the smoothing implements described above make them readily susceptible to convenient use and handling and render them impervious to the ravages of weather as well as highly resistant to breakage and wear.

Obviously, numerous modifications and variations of the present invention are possible in light of the above teachings. For example, collars 13, 23 or 33 could be disposed internally of respective cylindrical bodies 12, 22 and 32 rather than externally and handles 11, 21 or 31 could be affixed to respective collars 13, 23 and 33 by screw threading or other equivalent means. Additionally, it should be recognized by those skilled in the art that the cylindrical body and handle may be formed of other materials and methods than those described above. For example, various other types of plastics, lightweight metals or hard rubber may be employed. It is therefore to be understood that within the scope of the appended claims, the invention may be practiced otherwise than as specifically described herein.

I claim as my invention:

1. A golf sand-trap smoothing implement comprising:

(a) means for penetrating the surface of a sand trap in order to smooth said surface, said penetrating means comprising a unitary substantially cylindrical body having two ends and a longitudinal axis and having integrally formed therewith a plurality of raised ridges spaced along the longitudinal axis of said body and with each of said ridges extending circumferentially around substantially the entire periphery of said body, said ridges each defining an outermost edge which is generally constant in distance from said body along all portions of the circumference thereof, said ridges being relatively rigid and incapable of flexing with respect to said body; and (b) means for drawing said penetrating means through said sand trap just below said surface in order to effect said smoothing operation comprising elongated handle means and extending away from said body at an angle to said longitudinal axis thereof, said handle means being substantially greater in length than the length of said body between said two ends connected to said body.

2. The smoothing implement as set forth in claim 1, wherein said penetrating means is provided with tapered ends.

3. The smoothing implement as set forth in claim 2, wherein said penetrating means is provided with a substantially cylindrical collar for fixedly receiving said handle means.

4. The smoothing implement set forth in claim 3, wherein said handle means is press-fit within said collar.

5. The smoothing implement set forth in claim 1, wherein said ridges are equally spaced along the longitudinal axis of said body.

6. The smoothing implement set forth in claim 1, wherein each of said ridges is of uniform width throughout its extent.

7. The smoothing implement set forth in claim 1, wherein each of said ridges extends to a wedge-shaped edge.

* * * * *